US008176923B2

(12) United States Patent
Xue et al.

(10) Patent No.: US 8,176,923 B2
(45) Date of Patent: May 15, 2012

(54) SMOKING ARTICLES AND METHOD FOR TREATING TOBACCO MATERIAL WITH A SUSPENSION CONTAINING BISMUTH CONTAINING COMPOUNDS AND OPTIONALLY GLYCERIN

(75) Inventors: Lixin Xue, Midlothian, VA (US); W. Geoffrey Chan, Chesterfield, VA (US)

(73) Assignee: Philip Morris USA Inc., Richmond, VA (US)

( * ) Notice: Subject to any disclaimer, the term of this patent is extended or adjusted under 35 U.S.C. 154(b) by 269 days.

(21) Appl. No.: 12/155,225

(22) Filed: May 30, 2008

(65) Prior Publication Data

US 2009/0000632 A1 Jan. 1, 2009

Related U.S. Application Data

(60) Provisional application No. 60/924,815, filed on May 31, 2007.

(51) Int. Cl.
*A24B 15/00* (2006.01)

(52) U.S. Cl. ..... 131/309; 131/300

(58) Field of Classification Search ..... 131/309, 131/300

See application file for complete search history.

(56) References Cited

U.S. PATENT DOCUMENTS

| | | | | |
|---|---|---|---|---|
| 3,039,475 | A | 6/1962 | Neukomm et al. | |
| 3,211,800 | A * | 10/1965 | Bajars | 585/620 |
| 3,292,636 | A | 12/1966 | Mays | |
| 3,338,246 | A * | 8/1967 | Mays | 131/352 |
| 3,474,792 | A | 10/1969 | Miller, Jr. et al. | |
| 4,055,191 | A | 10/1977 | Norman et al. | |
| 4,216,784 | A | 8/1980 | Norman et al. | |
| 4,248,251 | A | 2/1981 | Bryant, Jr. et al. | |
| 4,449,541 | A | 5/1984 | Mays et al. | |
| 5,499,636 | A | 3/1996 | Baggett, Jr. et al. | |
| 5,915,387 | A | 6/1999 | Baggett, Jr. et al. | |
| 5,988,176 | A | 11/1999 | Baggett, Jr. et al. | |
| 6,026,820 | A | 2/2000 | Baggett, Jr. et al. | |
| 6,378,528 | B1 * | 4/2002 | Beeson et al. | 131/352 |
| 6,789,548 | B2 | 9/2004 | Bereman | |
| 6,799,578 | B2 | 10/2004 | Snaidr et al. | |
| 6,810,884 | B2 | 11/2004 | Snaidr et al. | |
| 6,904,918 | B2 | 6/2005 | Snaidr et al. | |
| 6,959,712 | B2 | 11/2005 | Bereman et al. | |
| 2003/0000538 | A1 * | 1/2003 | Bereman | 131/352 |
| 2005/0121045 | A1 | 6/2005 | Finlay et al. | |

(Continued)

OTHER PUBLICATIONS

Chakraborty, B. B. et al., "Reduction in the concentration of aromatic polycyclic hydrocarbons in cigarette smoke", Chem. Ind., Jun. 12, 1971, XP008109068, London, p. 672, URL:http://tobaccodocuments.org/ahf/88340847-0848.html>.

(Continued)

*Primary Examiner* — Richard Crispino
*Assistant Examiner* — Dionne Walls Mayes
(74) *Attorney, Agent, or Firm* — Buchanan Ingersoll & Rooney PC

(57) ABSTRACT

Provided is a method for reducing TPM cytotoxicity, mutagenicity, and/or phenolic compounds and polycyclic aromatic hydrocarbons in the particulate phase of mainstream smoke. Also provided is a smoking article including tobacco material treated with a bismuth containing compound and optionally glycerin. The method includes forming a suspension of a bismuth containing compound, water, and optionally glycerin. Tobacco material is contacted with the suspension, and then dried to evaporate the water. The tobacco material is used to form smoking articles with potentially reduced TPM cytotoxicity, mutagenicity, and/or targeted constituents in mainstream smoke.

17 Claims, 1 Drawing Sheet

U.S. PATENT DOCUMENTS

| | | | |
|---|---|---|---|
| 2006/0037621 | A1 | 2/2006 | Bereman et al. |
| 2006/0225753 | A1 | 10/2006 | Kaczmarek et al. |
| 2006/0283469 | A1 | 12/2006 | Lipowicz |

OTHER PUBLICATIONS

Kilburn, K. D., "R. & D.E. Proposals for the Janus B-10 Experiment", British Columbia's Tobacco Industry Documents, Guildford Depository, Nov. 17, 2000, XP002539485, Guildford, CA, pp. 1-3, URL:http://www.health.gov.bc.ca/guildford/pdf/126/00012639.pdf>.

Morrison, Lowen R., "Glycerol", Kirk-Othmer Encyclopedia of Chemical Technology, Dec. 4, 2000, XP002539520, pp. 1-13, URL:http://mrw.interscience.wiley.com/emrw/9780471238966/kirk/article/glycmorr.a01/current/pdf>.

International Search Report and Written Opinion mailed Aug. 12, 2009 for PCT/IB2008/002498.

* cited by examiner

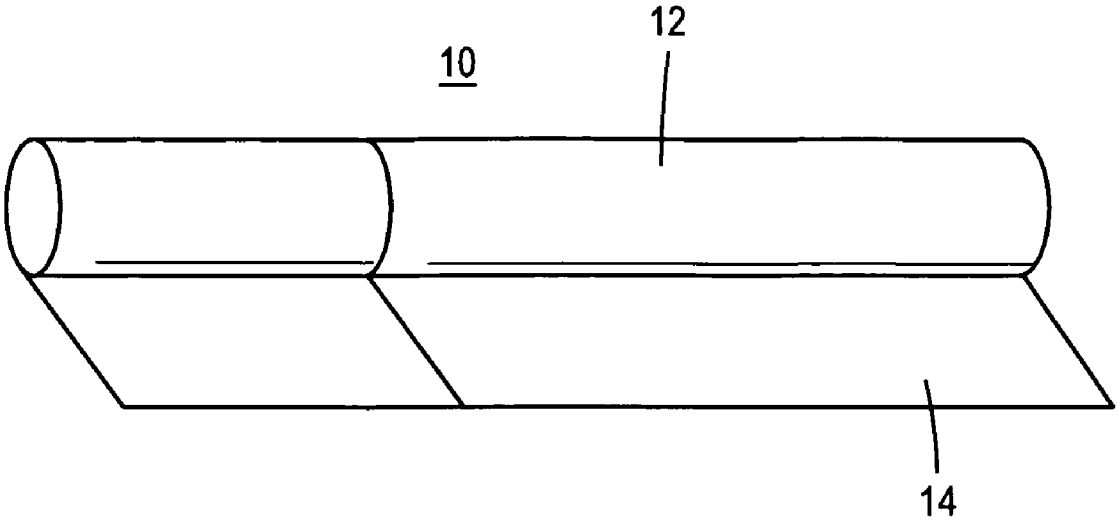
10
12
14

SMOKING ARTICLES AND METHOD FOR TREATING TOBACCO MATERIAL WITH A SUSPENSION CONTAINING BISMUTH CONTAINING COMPOUNDS AND OPTIONALLY GLYCERIN

This application claims priority under 35 USC §119 to U.S. Provisional Application No. 60/924,815 entitled SMOKING ARTICLES AND METHOD FOR TREATING TOBACCO MATERIAL WITH A SUSPENSION CONTAINING BISMUTH CONTAINING COMPOUNDS AND OPTIONALLY GLYCERIN and filed on May 31, 2007, the entire content of which is hereby incorporated by reference.

BACKGROUND

Smoking articles, such as cigarettes, produce both mainstream smoke during a puff and side stream smoke during static burning. Phenolic compounds, such as phenol, cresols, hydroquinone (HQ), and resorcinol, and polycyclic hydrocarbons (PAH), such as naphthalene, fluorine, anthracene, pyrene, and benzo[a]pyrene (BAP), can be found in the particulate phase of mainstream smoke.

SUMMARY

Provided is a method for reducing targeted constituents in mainstream tobacco smoke by incorporating bismuth containing compounds as an additive in tobacco filler used in making smoking articles. More specifically, the method includes treating tobacco material with a suspension including water, a bismuth containing compound, and optionally glycerin.

Preferred bismuth containing compounds include bismuth oxide ($Bi_2O_3$), bismuth(III)oxychloride (BiOCl), and bismuth sodium tartrate (BiNaTartrate). Most preferably, the bismuth containing compound is a small compound wherein the bismuth has a higher reactivity for targeted constituents in mainstream tobacco smoke.

The method includes mixing a bismuth containing compound with water to form a suspension. Preferably, the suspension is distributed over a tobacco material. In a preferred embodiment, the tobacco material is dried to evaporate the water and then incorporated into a smoking article.

In a preferred embodiment, the suspension also includes glycerin. Preferably, the glycerin acts as a diluent and also enhances the effect of the bismuth containing compound on targeted constituents of smoke.

Also provided is a smoking article for potentially reducing and removing targeted constituents in the particulate phase of mainstream tobacco smoke.

Preferably, the smoking article includes a tobacco material treated with a suspension containing a bismuth containing compound. Preferably, the bismuth containing compound is bismuth(III)oxychloride (BiOCl), bismuth oxide ($Bi_2O_3$) or bismuth sodium tartrate (BiNaTartrate).

In a preferred embodiment, the tobacco material contained in the smoking article is also treated with glycerin.

BRIEF DESCRIPTION OF THE DRAWINGS

FIG. 1 is an illustration of an embodiment of a smoking article including tobacco material treated with a suspension of water, a bismuth containing compound, and optionally glycerin.

DETAILED DESCRIPTION

A method for treating tobacco materials with a bismuth containing compound is described herein. Treating tobacco material with a bismuth containing compound aids in reducing the content of phenolic compounds, such as phenol, cresols, hydroquinone (HQ), and resorcinol, and polycyclic aromatic hydrocarbons (PAH), such as naphthalene, fluorine, anthracene, pyrene, and/or benzo[a]pyrene (BAP), in the particulate phase of mainstream smoke.

In another embodiment, when tobacco material is treated with a combination of a bismuth containing compound and glycerin, further reductions of targeted constituents are possible.

Preferably, the bismuth containing compound is selected from bismuth oxide ($Bi_2O_3$), bismuth(III)oxychloride (BiOCl), or bismuth sodium tartrate (BiNaTartrate). However, other bismuth containing compounds can also be used.

Not wishing to be bound by theory, it is believed that small bismuth containing compounds are preferred because the bismuth is better able to react with the targeted constituents such as phenolic compounds in the mainstream smoke when the bismuth containing compound is small. Small compounds are compounds, such as BiOCl, in which the bismuth has a large reactive surface area exposed for reaction. Because the bismuth has a large reactive surface, it is believed that the bismuth is more readily available for reaction with targeted constituents, and therefore able to remove such constituents from smoke.

Also not wishing to be bound by theory, in contrast, large chemical compounds such as bismuth sodium tartrate, while still effective in reducing some constituents, appear less reactive. It is believed that more complex bismuth containing compounds are less effective because the bismuth is tightly bound and becomes less reactive. However, larger bismuth containing compounds are still effective for removing phenolic compounds and reducing cytotoxicity and/or mutagenicity especially when used in conjunction with glycerin.

The method for treating tobacco material with a bismuth containing compound includes forming a suspension of water, the bismuth containing compound, and optionally glycerin.

Preferably, water is only needed in an amount suitable to suspend the bismuth containing compound. For example, 2.4 g of BiOCl can form a suspension with about 20 g of water.

The bismuth containing compound is added to the tobacco in an amount of about 0.5% to about 10% by weight of bismuth. More preferably, the bismuth containing compound is added in an amount of about 2% to about 7% by weight of bismuth.

In an embodiment, glycerin is added to the suspension so that once dried, the glycerin is included in the tobacco in an amount of about 2% to about 25% by weight of the tobacco. More preferably, glycerin is added to the tobacco material in an amount of about 5% to about 15% by weight of tobacco material. If too much glycerin is added, the wrapping paper of the tobacco rod of a smoking article may become too moist. The addition of glycerin to the suspension is in addition to an amount of glycerin that can be added to the tobacco material as a humectant.

In a preferred embodiment, glycerin is added in an amount which improves the dispersion of bismuth compounds in water and the subsequent distribution of the suspension throughout the tobacco material. Glycerin, when used alone acts as a diluent to reduce the relative amount of targeted constituents in tobacco smoke. However, when glycerin is used in conjunction with a bismuth containing compound to treat tobacco smoke, greater reductions in the cytotoxicity and/or mutagenicity of mainstream smoke are possible.

In an embodiment, after the suspension is formed, the tobacco material is placed in a tumbling device and drops of the suspension are introduced to the tobacco material through a nozzle. In another embodiment, the suspension is sprayed onto the tobacco material while in the tumbling device.

In a preferred embodiment, the tobacco material is dried to evaporate some or all of the water in the suspension, and processed for inclusion in a smoking article.

EXAMPLE 1

About 2.4 g of solid BiOCl is mixed with about 20 g of deionized water in a vial to form a white suspension. About 40 g of tobacco material is placed in a tumbling device. The white suspension is added to the tumbling device drop wise through a nozzle. The treated tobacco is dried and equilibrated in a conditioned room of 75° F./69% relative humidity (RH) overnight before use.

EXAMPLE 2

About 4.4 g of solid BiNaTartrate is mixed with about 20 g of deionized water in a vial to form a suspension. About 40 g of tobacco material is placed in a tumbling device. The suspension is added to the tumbling device drop wise through a nozzle. The treated tobacco is dried overnight and equilibrated in a conditioned room of 75° F./69% relative humidity (RH) overnight before use.

EXAMPLE 3

About 2.0 g of solid $Bi_2O_3$ is mixed with about 20 g of deionized water in a vial to form a suspension. About 40 g of tobacco material is placed in a tumbling device. The suspension is added to the tumbling device drop wise through a nozzle. The treated tobacco is dried overnight and equilibrated in a conditioned room of 75° F./69%RH overnight before use.

Table 1 shows the results of FTC smoking when the tobacco treated with bismuth containing compounds, either bismuth oxide ($Bi_2O_3$), bismuth oxychloride (BiOCl), or bismuth sodium tartrate (BiNaTartrate), is incorporated into a smoking article and smoked in a smoking machine equipped to measure various smoke constituents. Under FTC smoking conditions, the 3rd and 4th puffs of the mainstream TPM were collected. The relative phenolic and PAH contents were obtained by GC/MS methods. The TPM cytotoxicity and mutagenicity data were obtained using the Neutral Red Uptake and the Ames assays, respectively.

TABLE 1

| Compounds | 6% BiOCl AVG | 11% BiNaTartrate AVG | 5% $Bi_2O_3$ AVG |
|---|---|---|---|
| phenol | — | — | — |
| o-cresol | — | 21% | — |
| m/p-cresol | — | 26% | — |
| catechol | — | −34% | — |
| HQ | −24% | — | — |
| resorcinol | −31% | — | — |
| Naphthalene | −48% | −59% | −59% |
| Fluorene | — | — | — |
| Anthracene | — | — | — |
| Fluoranthene | — | — | — |
| Pyrene | — | — | — |
| BaP | — | — | — |
| Cytotoxicity | −32% | 29% | 1% |
| Mutagenicity | −36% | −10% | −37% |

*—: No significant change (absolute change <20%)

As shown in Table 1, by testing tobacco material with 6% BiOCl, a significant reduction in cytotoxicity and mutagenicity is seen. When treating tobacco material with 11% BiNaTartrate, a reduction in mutagenicity is seen, but the cytotoxicity is increased. When treating tobacco material with 5% $Bi_2O_3$, a 37% reduction in mutagenicity is seen, while the cytotoxicity remains unchanged.

As shown in Examples 4, 5, and 6 and Table 2, the addition of glycerin to the suspension used to treat the tobacco material improves the reduction of targeted constituents, cytotoxicity, and mutagenicity.

EXAMPLE 4

About 4.0 g of glycerin is dissolved in about 20 g of deionized water. About 2.4 g of solid BiOCl is added to the solution to form a white suspension. About 40 g of tobacco material is placed in a tumbling device. The white suspension is sprayed into the tumbling device through a spraying nozzle. The treated tobacco is dried overnight and equilibrated in a conditioned room of 75° F./69% RH overnight before use.

EXAMPLE 5

About 4.0 g of glycerin is dissolved in about 20 g of deionized water. About 4.4 g of solid BiNaTartrate is added to the solution to form a white suspension. About 40 g of tobacco material is placed in a tumbling device. The white suspension is sprayed into the tumbling device through a spraying nozzle. The treated tobacco is dried overnight and equilibrated in a conditioned room of 75° F./69% RH overnight before use.

EXAMPLE 6

About 4.0 g of glycerin is dissolved in about 20 g of deionized water. About 2.0 g of solid $Bi_2O_3$ is added to the solution to form a white suspension. About 40 g of tobacco material is placed in a tumbling device. The white suspension is sprayed into the tumbling device through a spraying nozzle. The treated tobacco is dried overnight and equilibrated in a conditioned room of 75° F./69% RH overnight before use.

Table 2 shows the results of an FTC test on the mainstream smoke of a smoking article made with tobacco material treated with glycerin and the bismuth containing compounds.

TABLE 2

| Compounds | 6% BiOCl/ 10% Glycerin AVG | 9% BiNaTartrate/ 10% Glycerin AVG | 5% $Bi_2O_3$/ 10% Glycerin AVG | 10% Glycerin AVG |
|---|---|---|---|---|
| phenol | −54% | −77% | — | −73% |
| o-cresol | −45% | −62% | — | −66% |
| m/p-cresol | −47% | −65% | — | −68% |
| catechol | −33% | −33% | — | −34% |
| HQ | −56% | −57% | −20% | −48% |
| resorcinol | −76% | −65% | −32% | −30% |
| Naphthalene | −44% | −31 | −54% | −50% |
| Fluorene | −37% | — | −41% | −39% |
| Phenantrene | — | — | −34% | −26% |
| Anthracene | −23% | — | −48% | −24% |
| Fluoranthene | — | — | −20% | −22% |
| Pyrene | — | — | −23% | — |
| BaA | — | — | −26% | −24% |
| Chrysene | — | — | −22% | −27% |
| BaP | — | −32% | −26% | −25% |
| Cytotoxicity | −40% | −32% | −44% | −32% |
| Mutagenicity | −40% | −33% | −47% | −15% |

*—: No significant change (absolute change <20%)

The addition of glycerin to the suspension improves the smoke chemistry of the cigarettes incorporating tobacco material treated with BiOCl, $Bi_2O_3$, and BiNaTartrate resulting in enhanced reduction in targeted constituents as compared to the cigarettes containing tobacco treated with only a bismuth containing compound as shown in Table 1.

For tobacco materials treated with either 6% BiOCl/10% Glycerin, 5% $Bi_2O_3$/10% Glycerin, or 9% BiNaTartrate/10% Glycerin a significant reduction in cytotoxicity and mutagenicity is demonstrated as compared to cigarettes containing tobacco treated with a bismuth containing compound alone.

As shown in Table 2, reductions in phenolic and polycyclic aromatic hydrocarbon content is also observed when treating tobacco material with 6% BiOCl and 10% Glycerin, 9% BiNaTartrate and 10% Glycerin, or 5% $Bi_2O_3$ and 10% Glycerin.

While reduction in phenolic and polycyclic aromatic hydrocarbon content is also observed when treating the tobacco material with glycerin alone, it appears that glycerin in combination with bismuth containing compounds provides a synergistic effect that results in greater reductions in cytotoxicity, and mutagenicity when glycerin and the bismuth containing compound are used together.

Also provided is a smoking article 10 including tobacco material 12 treated with a suspension containing water and a bismuth containing compound and wrapped with a wrapper 14, as seen in FIG. 1. Preferably, the smoking article 10 provides reduced cytotoxicity and mutagenicity. Preferably, the smoking article 10 containing tobacco material 12 treated with a suspension including bismuth containing compound aids in reducing the content of phenolic compounds, such as phenol, cresols, hydroquinone, and resorcinol, and polycyclic aromatic hydrocarbons (PAH), such as naphthalene, fluorene, anthracene, pyrene, chrysene, phenantrene, fluoranthene, and benzo[a]pyrene (BAP), in the particulate phase of mainstream smoke.

In an embodiment, when the tobacco material 12 is treated with a bismuth containing compound selected from BiOCl, $Bi_2O_3$, or BiNaTartrate, a reduction in naphthalene in the particulate phase of smoke is also provided.

The term "smoking article" includes cigarettes, pipes, cigars, and cigarillos. Non-traditional cigarettes such as cigarettes for electrical smoking systems as described in commonly-assigned U.S. Pat. Nos. 6,026,820; 5,988,176; 5,915,387; and 5,499,636, are also included in the definition of smoking articles or cigarettes generally.

Preferably, the smoking article is a cigarette. In an embodiment, the cigarette may contain tobacco material and a filter. In another embodiment, the cigarette may also contain at least one sorbent.

A traditional cigarette typically contains two sections, a tobacco-containing portion sometimes referred to as the tobacco or cigarette rod, and a filter portion which may be referred to as a filtration zone. Tipping paper typically surrounds the filter, which forms the buccal end of the cigarette. The tipping paper overlaps with the tobacco rod in order to hold the filter and tobacco rod together. The tobacco rod, or tobacco containing element of the cigarette includes the paper wrapper in which the tobacco is wrapped and the adhesive holding the seams of the paper wrapper together.

The "upstream" and "downstream" relative positions between filter segments and other features are described in relation to the direction of mainstream smoke as it is drawn from a tobacco rod and though a multi-component filter during a puff.

In a preferred embodiment, the filter of the smoking article includes a sorbent. A "sorbent" is a substance that can condense or hold molecules of other substances on its surface, and/or can take up other substances, i.e., through penetration of the other substances into its inner structure, or into its pores. Accordingly, the term "sorbent" as used herein refers to either an adsorbent, an absorbent, or a substance that can function as both an adsorbent and an absorbent. The term "sorbent" may also be combined with catalysts. Preferred sorbents include various forms of activated carbon, molecular sieves, such as zeolites, and mixtures thereof.

As used herein, the term "remove" refers to adsorption and/or absorption of at least some portion of at least one constituent of mainstream smoke.

Examples of suitable types of tobacco materials that may be used include, but are not limited to, flue-cured tobacco, Burley tobacco, Maryland tobacco, Oriental tobacco, rare tobacco, specialty tobacco, genetically modified tobacco, blends thereof and the like. The tobacco material may be provided in any suitable form, including, but not limited to, tobacco lamina, processed tobacco materials, such as volume expanded or puffed tobacco, processed tobacco stems, such as cut-rolled or cut-puffed stems, reconstituted tobacco materials, blends thereof, and the like. Tobacco substitutes may also be used.

Humectants, flavorants, and sweeteners may also be blended with the tobacco material.

Humectants can also be added to the tobacco material 12. Examples of humectants that can be used with the tobacco material 12 include glycerin, triethylene glycol and propylene glycol. The humectants may also be provided for a preservative effect, as the water activity of the product can be decreased with inclusion of a humectant. In turn, the opportunity for growth of micro-organisms is diminished.

Suitable flavor additives and aromas for inclusion in the smoking article 10 include, but are not limited to, any natural or synthetic flavor or aroma, such as tobacco, smoke, menthol, peppermint, spearmint, bourbon, scotch, whiskey, cognac, hydrangea, lavender, chocolate, licorice, citrus and other fruit flavors, such as apple, peach, pear, cherry, plum, orange and grapefruit, gamma octalactone, vanillin, ethyl vanillin, breath freshener flavors, spice flavors such as cinnamon, clove, nutmeg, sage, anise, and fennel, methyl salicylate, linalool, jasmine, coffee, bergamot oil, geranium oil, lemon oil, and ginger oil. Other suitable flavors and aromas may include flavor compounds selected from the group consisting of an acid, an alcohol, an ester, and aldehyde, a ketone, a pyrazine, combinations or blends thereof and the like. Suitable flavor compounds may be selected, for example, from the group consisting of phenylacetic acid, solanone, megastimatrienone, 2-heptanone, benzyl alcohol, cis-3-hexenyl acetate, valeric acid, valeric aldehyde, ester, terpene, sequiterpene, nootkatone, maltol, damascenone, pyrazine, lactone, anethole, isovaleric acid, combinations thereof and the like.

In an embodiment, the tobacco material 12 contained in the smoking article 10 also includes additives such as natural or artificial sweeteners. Preferred sweeteners include, without limitation, water soluble sweeteners such as monosaccharides, disaccharides, and polysaccharides such as xylose, ribose, sucrose, maltose, fructose, glucose, and mannose.

In a preferred embodiment, the tobacco material 12 is treated with a suspension containing water and a bismuth containing compound. Preferably, the bismuth containing compound is bismuth(III)oxychloride, bismuth oxide, or bismuth sodium tartrate.

Preferably, the suspension is added to the tobacco material so that the bismuth containing compound is present in the smoking article in an amount of about 0.5% to about 10% by weight of bismuth.

While the foregoing has been described in detail with reference to specific embodiments thereof, it will be apparent to one skilled in the art that various changes and modifications may be made, and equivalents thereof employed, without departing from the scope of the claims.

What is claimed is:

1. A method for treating tobacco comprising:

contacting a portion of tobacco material with a suspension including water, glycerin and a bismuth containing compound to form a treated tobacco material; and evaporating the water from said treated tobacco material, wherein glycerin is included in said tobacco material in an amount of about 5% to about 25% and wherein the bismuth containing compound is bismuth (III) oxychloride and/or bismuth sodium tartrate.

2. The method of claim 1, wherein said bismuth containing compound is sprayed onto said portion of tobacco material.

3. The method of claim 1, wherein said bismuth containing compound is added drop-wise to said portion of tobacco material.

4. The method of claim 1, wherein said treated tobacco material is added to a smoking article.

5. The method of claim 4, wherein said smoking article includes said bismuth containing compound in an amount of about 1% to about 15% by weight of bismuth.

6. The method of claim 1, wherein the bismuth in said bismuth containing compound has a large reactive surface available for reaction.

7. The method of claim 1, wherein the bismuth containing compound is bismuth (III) oxychloride.

8. A smoking article comprising:

a portion of tobacco material including a bismuth containing compound and glycerin; and a wrapper, wherein the bismuth containing compound is bismuth(III) oxychloride and/or bismuth sodium tartrate, wherein glycerin is included in said smoking article in an amount of about 5% to about 25%.

9. The smoking article of claim 8, wherein the bismuth in said bismuth containing compound has a large reactive surface available for reaction.

10. The smoking article of claim 8, wherein said smoking article includes said bismuth containing compound in an amount of about 1% to about 15% by weight of bismuth.

11. The smoking article of claim 8, further including (a) humectants; (b) sweeteners; and/or (c) flavorants.

12. The smoking article of claim 8, wherein said bismuth containing compound is present in an amount effective to reduce the content of phenolic compounds in the particulate phase of mainstream smoke.

13. A method of treating tobacco smoke produced by the smoking article of claim 8, wherein the tobacco smoke reacts with the bismuth and the cytotoxicity of tobacco smoke and/or polycyclic aromatic hydrocarbons produced by said smoking article is reduced by at least about 10%.

14. A method of treating tobacco smoke produced by the smoking article of claim 8, wherein the tobacco smoke reacts with the bismuth and the mutagenicity of tobacco smoke produced by said smoking article is reduced by at least about 10%.

15. A method of treating tobacco smoke produced by the smoking article of claim 8, wherein (i) the bismuth and glycerin reduces the cytotoxicity of tobacco smoke produced by said smoking article by at least about 10%, and/or (ii) the bismuth and glycerin reduces the mutagenicity of said smoking article by at least about 10%.

16. A method of treating tobacco smoke produced by the smoking article of claim 8, wherein said bismuth containing compound reduces the content of phenolic compounds and/or polycyclic aromatic hydrocarbons in the particulate phase of mainstream smoke.

17. The method of claim 8, wherein the bismuth containing compound is bismuth(III)oxychloride.

* * * * *